US007488910B2

(12) United States Patent
Hong

(10) Patent No.: US 7,488,910 B2
(45) Date of Patent: Feb. 10, 2009

(54) KEY ASSEMBLY AND MOBILE TERMINAL HAVING THE SAME

(75) Inventor: Sang-Ki Hong, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/649,859

(22) Filed: Jan. 5, 2007

(65) Prior Publication Data

US 2008/0062670 A1 Mar. 13, 2008

(30) Foreign Application Priority Data

Sep. 12, 2006 (KR) ..... 10-2006-0088268

(51) Int. Cl.
*H01H 9/00* (2006.01)

(52) U.S. Cl. ..... 200/310; 200/314

(58) Field of Classification Search ..... 200/310
See application file for complete search history.

(56) References Cited

U.S. PATENT DOCUMENTS 6,977,352 B2 * 12/2005 Oosawa ..... 200/314
7,014,377 B2 * 3/2006 Yamauchi ..... 400/472
7,070,349 B2 * 7/2006 Dombrowski et al. ..... 400/490
2002/0054487 A1 * 5/2002 Parker et al. ..... 362/29
2006/0260923 A1 * 11/2006 Lee et al. ..... 200/314
2007/0039809 A1 * 2/2007 Aihara et al. ..... 200/310

FOREIGN PATENT DOCUMENTS

KR 1020050056026 A 6/2005
KR 1020050056090 A 6/2005
KR 1020050064351 A 6/2005
RU 2005138319 A 5/2006
RU 2006112012 A 8/2006

* cited by examiner

*Primary Examiner*—Elvin G Enad
*Assistant Examiner*—Lheiren Mae A Anglo
(74) *Attorney, Agent, or Firm*—Birch, Stewart, Kolasch & Birch, LLP

(57) ABSTRACT

A key assembly and a mobile terminal having the same. The key assembly includes a plurality of key buttons, a light guiding sheet arranged below at least one of the plurality of key buttons, a light emitter to generate light into an edge of the light guiding sheet, the light guiding sheet directing light from the light emitter towards at least one of the plurality of key buttons, a circuitry supporting substrate formed below the light guiding sheet; and a plurality of switches formed on the circuitry supporting substrate, each of the plurality of switches corresponding to one of the plurality of key buttons. The light guiding sheet overlays an upper portion of each of the plurality of switches.

20 Claims, 3 Drawing Sheets

KEY ASSEMBLY AND MOBILE TERMINAL HAVING THE SAME

CROSS REFERENCE TO RELATED APPLICATIONS

This application claims priority to Korean Patent Application No. 10-2006-0088268, filed Sep. 12, 2006, and is herein incorporated by reference.

BACKGROUND OF THE INVENTION

1. Field of the Invention

The present invention relates to a key assembly for a mobile terminal, and a mobile terminal having the same.

2. Description of Related Art

A mobile terminal is one of many portable electronic devices capable of enabling a user to wirelessly transmit/receive data or to process information while being moved. As the mobile terminal becomes lighter and slimmer in order for the user to conveniently carry it, the mobile terminal requires a mechanical structure to implement various functions in a small and limited device.

Generally, the mobile terminal is provided with a key assembly having a plurality of key buttons to input numbers, characters, and other control commands by the user. FIG. 1 is a sectional view showing a key assembly in accordance with the related art. As shown, the related art key assembly 1 comprises a plurality of key buttons 2 exposed outside the mobile terminal and is pressably-operated. A switch 6 is arranged below the key buttons 2 and is mounted on an upper surface of a circuit board 4, for receiving a signal as the key buttons 2 are pressed. A pad 3 is attached to a lower surface of the key buttons 2 and is elastically transformed when the key buttons 2 are pressed, for pressurizing the switch 6 to thereby input a signal. A pressurizing protrusion 7 for pressurizing the switch 6 as the key buttons 2 are pressed is disposed at the pad 3.

The key buttons 2 are arranged on a case 9 so as to be outwardly exposed, and have symbols such as numbers, characters, or other command prompts, on the upper surfaces of the key buttons 2. The symbols are printed as a negative type to selectively pass light generated from light emitting diodes (LEDs) 5, which will be explained later, thereby implementing a backlighting of the symbols.

When a user pushes the key buttons 2, the pressurizing protrusion 7 of the pad 3 is pressed against switch 6. Accordingly, the user can input the desired keys.

A plurality of LEDs 5 for illuminating the key buttons 2 are upwardly protruding near the switches 6 of the circuit board 4. The symbols on the key buttons 2 are illuminated by the LEDs 5, so that the user can input the symbols even in a dark place.

However, in the related key assembly art, light is not uniformly distributed because of the distance between the LEDs 5 and the key buttons 2. Furthermore, in order to enhance the brightness of the key buttons 2, the number of the LEDs 5 have to be increased, thereby requiring a larger power consumption.

In order to solve the above problems, the Korean Patent Publication No. 10-2003-89182 discloses a technique for arranging a light guiding plate on an upper surface of a main board having dome switches, the light guiding plate having passing holes in correspondence with the dome switches.

However, in the Korean Patent Publication No. 10-2003-89182, the number of the passing holes corresponds to the number of the dome switches, thereby requiring a difficult processing operation. Furthermore, a large amount of light disappears in the light guiding plate, thereby not sufficiently illuminating each of the key buttons.

Korean Patent Publication No. 10-2005-64351 discloses a technique that a light guiding plate is attached to a lower surface of a keypad and a light emitting device is mounted on an additional circuit board attached to the light guiding plate. However, since the light emitting device is installed separately from the main board, an additional structure for fixing the light emitting device and an electric connection unit are required. Accordingly, an entire process is complicated and a fabrication cost is increased.

BRIEF SUMMARY OF THE INVENTION

According to principles of this invention, a key assembly capable of reducing the number of optical sources and an amount of power consumption by applying a light guiding member to a key assembly, and a mobile terminal having the same are provided.

To achieve these and other advantages and in accordance with the purpose of the present invention, as embodied and broadly described herein, there is provided a key assembly having a plurality of key buttons, a light guiding sheet arranged below at least one of the plurality of key buttons, a light emitter to generate light into an edge of the light guiding sheet, the light guiding sheet directing light from the light emitter towards at least one of the plurality of key buttons, a circuitry supporting substrate formed below the light guiding sheet; and a plurality of switches formed on the circuitry supporting substrate, each of the plurality of switches corresponding to one of the plurality of key buttons. The light guiding sheet overlays an upper portion of each of the plurality of switches.

In another aspect, the light guiding sheet is arranged below all of the plurality of key buttons and the light guiding sheet directs light from the light emitter towards all of the plurality of key buttons.

In a further aspect, the key assembly includes a reflective layer located at a perimeter of the light guiding sheet for redirecting light from the light emitter away from the perimeter.

In yet a further aspect, the light emitter may be mounted on an upper surface of the circuitry supporting substrate.

In still another aspect, each of the plurality of switches is formed to have a dome shape, and the light guiding sheet is formed of a flexible material that prevents adjacent switches from being pressed when a switch corresponding to one of the key buttons is pressed.

In another aspect, the light guiding sheet is attached onto the circuitry supporting substrate by an adhesive or a double sided tape deposited onto a lower surface thereof along an edge thereof.

In a further aspect, a plurality of reflection pattern portions for intensively guiding light from the light emitter to each of the key buttons is formed at a lower surface of the light guiding sheet in correspondence with the plurality of key buttons.

In still another aspect, the plurality of key buttons are formed as an integral pad, and the pad includes an opaque layer forming an appearance and having symbols penetratingly formed in correspondence with numbers or characters to be inputted, the opaque layer defining an upper surface for each of the plurality of buttons. The pad also includes a transparent layer formed at a lower surface of the opaque layer and integral with the opaque layer and a plurality of pressurizing protrusions formed at a lower surface of the transparent layer. Each of the pressurizing protrusions correspond to one of the plurality of key buttons and one of the plurality of switches. The opaque layer may be formed of a metallic plate and the transparent layer may be formed of silicon or silicon rubber co-injection molded onto the metallic plate.

According to another aspect of the present invention, a mobile terminal is provided that incorporates one or more of the above features of the key assembly.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the present invention, examples of which are illustrated in the accompanying drawings. Hereinafter, a key assembly and a mobile terminal having the same according to the present invention will be explained in more detail.

Figure 1:
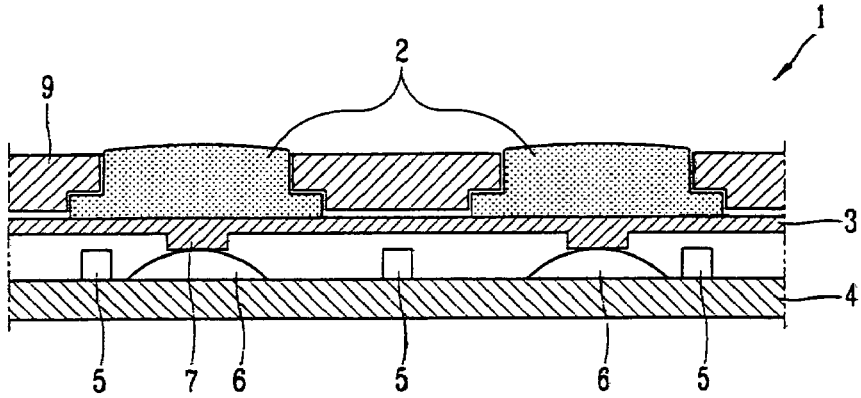
FIG. 1 RELATED ART
FIG. 1 is a sectional view showing a key assembly for a mobile terminal in accordance with the related art.
Figure 2:
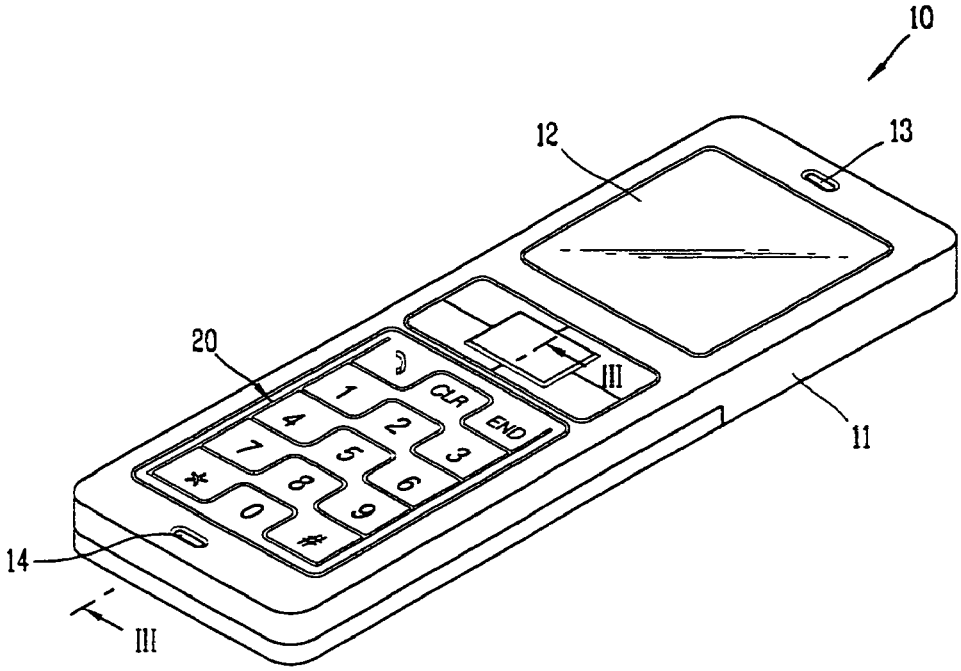
FIG. 2 is a perspective view showing a mobile terminal according to an exemplary embodiment of the present invention.

FIG. 2 is a perspective view showing a mobile terminal according to an exemplary embodiment of the present invention. As shown in FIG. 2, a mobile terminal 10 is provided with a terminal body 11 on which a key assembly 20 is installed.

A display 12 for displaying video information is provided at a front surface of the terminal body 11, and the key assembly 20 is provided at one side of the display 12. A receiver or a speaker 13 for outputting a voice signal may be mounted at an upper end of the terminal body 11, and a microphone 14 for inputting a voice signal may be mounted at a lower end of the terminal body 11.

Figure 3:
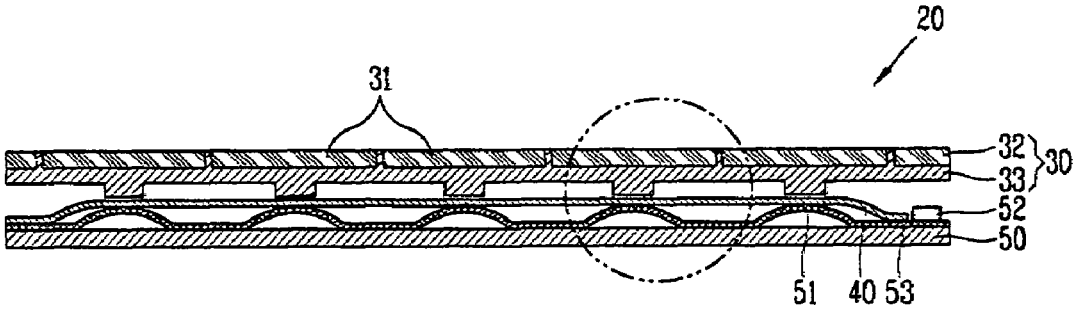
FIG. 3 is a sectional view taken along line III-III of FIG. 2.
Figure 3A:
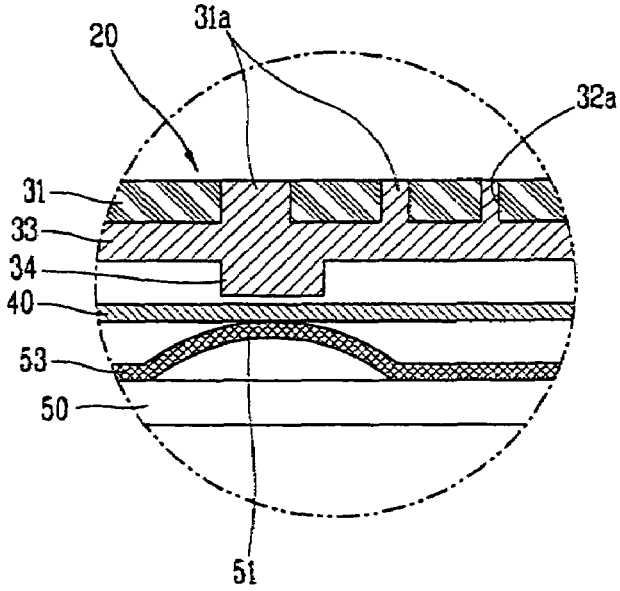
FIG. 3A is a close-up view of a portion of the sectional view of FIG. 3.
Figure 4:
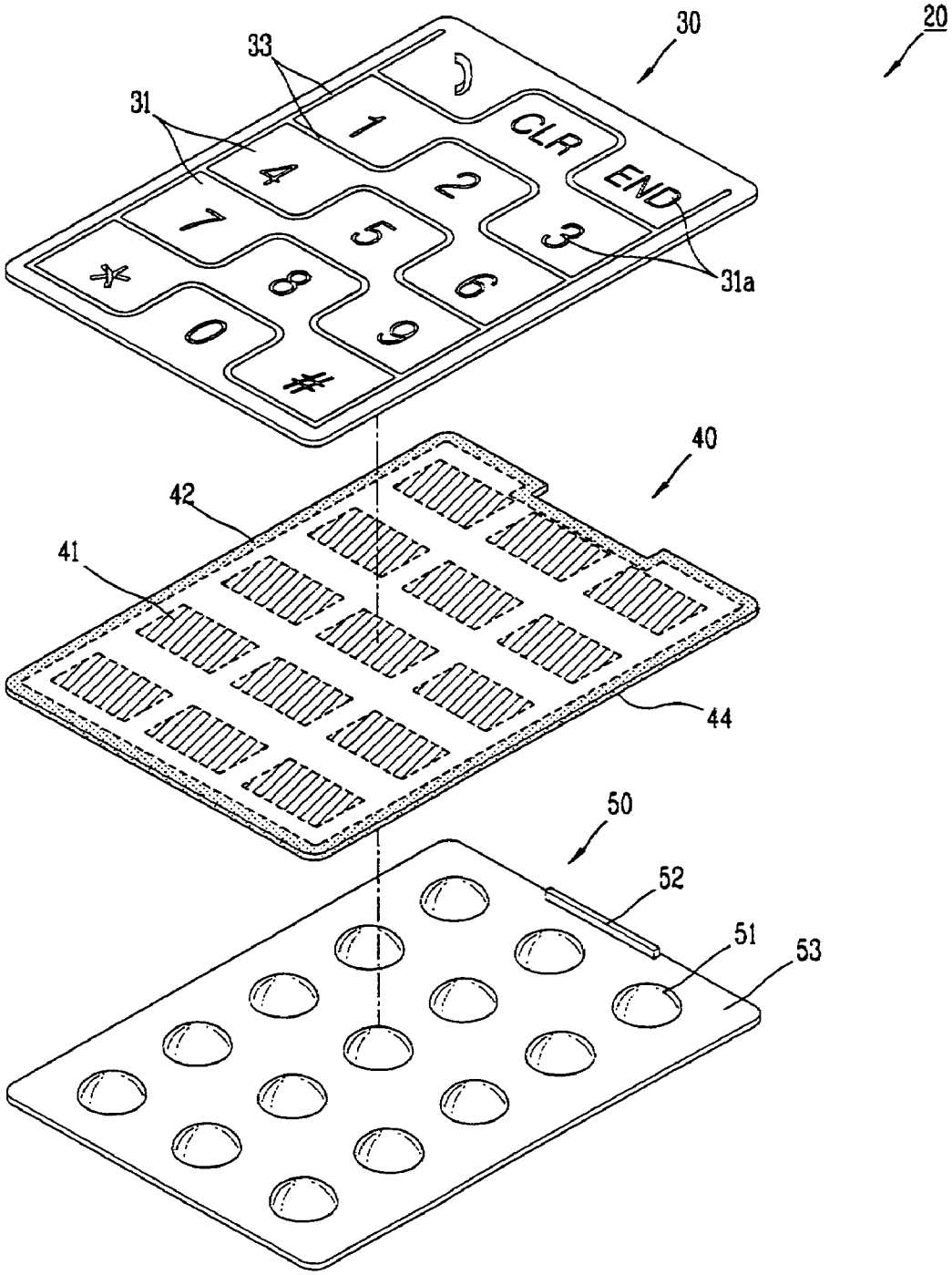
FIG. 4 is a disassembled perspective view of a key assembly of FIG. 2.

FIG. 3 is a sectional view taken along line III-III of FIG. 2, and FIG. 4 is a disassembled perspective view of a key assembly of FIG. 2. As shown in FIGS. 3 and 4, a plurality of key buttons 31 are arranged to be exposed outside the mobile terminal 10 and may be formed as one integrated pad 30.

In particular, as best seen in FIG. 4, the pad 30 includes an opaque layer 32 forming an appearance of key buttons 31 and having symbols 31*a* penetratingly formed thereon. The symbols correspond with numbers or characters to be inputted. A transparent layer 33 is integrally formed at a lower surface of the opaque layer 32 and a plurality of pressurizing protrusions 34 is formed at a lower surface of the transparent layer 33, each of which corresponds to one of the key buttons 31. The pressurizing protrusion 34 is for pressurizing a switch 51 that will be later explained.

The opaque layer 32 may be formed of a metallic plate having an excellent rigidity and durability, and the transparent layer 33 may be formed of silicon or silicon rubber co-injection molded onto the metallic plate. Alternatively, the opaque layer 32 may be formed of a transparent plastic and symbols representing numbers or characters to be inputted when the key buttons 31 are pressed may be printed on an upper surface, a lower surface, or a middle portion of each of the key buttons 31 as a negative type for backlighting.

In order to prevent adjacent key buttons 31 from being pressed when one key button 31 is pressed, and in order to easily recognize the key buttons 31, the opaque layer 32 is formed with a cut-shape 32*a* in the opaque layer 32. The transparent layer 33 fills in a cut-out portion 31*a* by molding, thereby preventing foreign materials from being introduced into the cut-out portion 31*a*. Also, when light is generated from a lower portion of the pad, dividing lines for dividing the key buttons 31 from each other are visible.

A circuitry supporting substrate, such as printed circuit board 50, is provided at a lower portion of the pad 30, and has dome-switches 51 arranged in correspondence with each of the key buttons 31 on an upper surface thereof. Preferably, a thin flexible circuitry supporting substrate or board may be used as the board 50, thereby reducing an entire thickness of the mobile terminal.

A light guiding sheet 40 for guiding light generated from a light emitter 52 mounted at a board 50 to each of the key buttons 31 is disposed on an upper surface of the board 50 and a plurality of switches 51. As shown in FIGS. 3 and 4, the light guiding sheet 40 is integrally formed so as to cover the board 50 and the switches 51 at one time. Also, the light emitter 52 is adjacent to a lateral surface of the light guiding sheet 40 so that light generated from the light emitter 52 arranged on one surface of the board 50 can be made to be incident onto the lateral surface of the light guiding sheet 40. A planar surface 53 may be provided to connect each of the plurality of switches together and the planar surface 53 may be made of reflective material or have a reflective layer formed thereon.

By mounting the light emitter 52 on the board 50, the fabrication process of the key assembly 20 can be simplified. As the light emitter 52, an optical source such as a LED having a high brightness in contrast to the power consumed is preferably used. Furthermore, since the light guiding sheet 40 does not shield light, light generated from one light emitter 52 can be transmitted to all of the key buttons. Accordingly, the number of optical sources and power can be reduced.

Preferably, the light guiding sheet 40 is formed of a flexible material that can be easily deformed so as to prevent adjacent key buttons 31 from being pressed when one specific key button 31 is pressed. When the key buttons 31 are pressed, the corresponding pressurizing protrusion 34 presses the light guiding sheet 40, and the light guiding sheet 40 presses the switch 51. Accordingly, the light guiding sheet 40 moves with the switch 51. When the pressing force applied to the key buttons 31 is removed, the light guiding sheet 40 is restored to the original position by an elastic force of the switch 51.

The light guiding sheet 40 is formed so that light incident from a lateral surface thereof can move towards a front surface thereof through reflection. Also, the light guiding sheet 40 is provided with reflection pattern portions 41 for intensively guiding light to each of the key buttons 31. Each of the reflection pattern portions has an area corresponding to each of the switches 51. The reflection pattern portion 41 is implemented by forming minute scratches or pits at a lower surface of the light guiding sheet 40 by an etching, laser processing, or other suitable processes.

The light guiding sheet 40 is attached onto the board by an adhesive or a double sided tape 42 deposited onto a lower surface thereof along an edge thereof, thereby facilitating an assembly.

In addition, a reflective layer 44 may also be provided at a perimeter of the light guiding sheet 40 to redirect light from the light emitter 52 away from the perimeter and towards the plurality of button keys 31. As seen in FIG. 4, the reflective layer 44 may be formed substantially above the adhesive layer 42.

The light guiding sheet 40 may be formed of poly-carbonate or poly-urethane, or other suitable material with a thickness of approximately 0.125 mm, thereby making the mobile terminal slim.

Hereinafter, an operation of the key assembly according to the present invention will be explained. Referring to FIG. 3, light generated from the light emitter 52 is made to be incident onto the light guiding sheet 40. Then, the light moves in the light guiding sheet 40 through a total reflection. As the light moves towards each of the key buttons 31, characters or numbers 31*a* of the key buttons 31 are illuminated.

Referring to FIG. 4, the light guiding sheet 40 is directly attached onto the board 50, thereby requiring no additional assembly process therebetween. Since the light guiding sheet 40 is formed so as to cover both the board 50 and the switch 51, light generated from the light emitter 52 is not shielded in the light guiding sheet 40. Accordingly, the number of the light emitters 52 can be reduced, and power consumption can be decreased.

As aforementioned, in the key assembly and the mobile terminal having the same, the light guiding sheet for guiding light generated from the light emitter mounted at the board to the key buttons is disposed on an upper surface of the switch. Accordingly, light generated from the light emitter 52 is not shielded in the light guiding sheet 40. Accordingly, the number of the light emitters 52 can be reduced, and power consumption can be decreased. While only a single light emitter 52 has been shown, it is understood that more than one light emitter may be provided and still minimize the power consumption for illuminating the button keys 31.

Furthermore, since the light emitter is mounted at the board, an additional component for installing the light emitter is not required, and an entire assembly process is simplified.

In the exemplary embodiment, a mobile terminal having an integrated terminal body was provided. However, the key assembly of the present invention may also be applied to a folder type or a slide type mobile terminal having at least two bodies.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed:

1. A key assembly comprising:

a plurality of key buttons;

a light guiding sheet arranged below at least one of the plurality of key buttons, the light guiding sheet having a lower surface;

a light emitter to generate light into an edge of the light guiding sheet, the light guiding sheet directing light from the light emitter towards at least one of the plurality of key buttons;

a circuitry supporting substrate formed below the light guiding sheet, the circuitry supporting substrate having an upper surface; and a plurality of switches formed on the circuitry supporting substrate, each of the plurality of switches corresponding to one of the plurality of key buttons;

wherein the lower surface of the light guiding sheet is attached to the upper surface of the circuitry supporting substrate by an adhesive, and a portion of the lower surface of the light guiding sheet is free of the adhesive.

2. The key assembly according to claim 1, further comprising:

a reflective layer located at a perimeter of the light guiding sheet for redirecting light from the light emitter away from the perimeter.

3. The key assembly of claim 2, wherein the light emitter is mounted on an upper surface of the circuitry supporting substrate.

4. The key assembly of claim 2, wherein each of the plurality of switches is formed to have a dome shape, and the light guiding sheet is formed of a flexible material that prevents adjacent switches from being pressed when a switch corresponding to one of the key buttons is pressed.

5. The key assembly of claim 2, wherein adhesive is double sided tape deposited onto the lower surface of the light guiding sheet along an edge thereof.

6. The key assembly of claim 2, wherein a plurality of reflection pattern portions for intensively guiding light from the light emitter to each of the key buttons is formed at a surface of the light guiding sheet in correspondence with the plurality of key buttons.

7. The key assembly of claim 1, wherein the plurality of key buttons is formed as an integral pad, and the pad comprises:

an opaque layer forming an appearance and having symbols penetratingly formed in correspondence with numbers or characters to be inputted, the opaque layer defining an upper surface for each of the plurality of buttons;

a transparent layer formed at a lower surface of the opaque layer and integral with the opaque layer; and a plurality of pressurizing protrusions formed at a lower surface of the transparent layer, each pressurizing protrusion corresponding to one of the plurality of key buttons and one of the plurality of switches.

8. The key assembly of claim 7, wherein the opaque layer is formed of a metallic plate, and the transparent layer is formed of silicon or silicon rubber co-injection molded onto the metallic plate.

9. The key assembly of claim 1, wherein the portion of the lower surface free of the adhesive extends generally parallel between all switches of the plurality of switches at the upper portions thereof.

10. The key assembly of claim 1, wherein the light guiding sheet has a perimeter, and the adhesive is only located at the perimeter.

11. A mobile terminal comprising:

a body; and a key assembly mounted on the body, the key assembly including:

a plurality of key buttons;

a light guiding sheet arranged below at least one of the plurality of key buttons, the light guiding sheet having a lower surface; and a light emitter to generate light into an edge of the light guiding sheet, the light guiding sheet directing light from the light emitter towards at least one of the plurality of key buttons;

a circuitry supporting substrate formed below the light guiding sheet, the circuitry supporting substrate having an upper surface; and a plurality of switches formed on the circuitry supporting substrate, each of the plurality of switches corresponding to one of the plurality of key buttons;

wherein the lower surface of the light guiding sheet is attached to the upper surface of the circuitry supporting substrate by an adhesive, and a portion of the lower surface of the light guiding sheet is free of the adhesive.

12. The mobile terminal according to claim 11, further comprising:

a reflective layer located at a perimeter of the light guiding sheet for redirecting light from the light emitter away from the perimeter.

13. The mobile terminal of claim 12, wherein the light emitter is mounted on an upper surface of the circuitry supporting substrate.

14. The mobile terminal of claim 12, wherein each of the plurality of switches is formed to have a dome shape, and the light guiding sheet is formed of a flexible material that prevents adjacent switches from being pressed when a switch corresponding to one of the key buttons is pressed.

15. The mobile terminal of claim 12, wherein the adhesive is a double sided tape deposited onto the lower surface of the light guiding sheet along an edge thereof.

16. The mobile terminal of claim 12, wherein a plurality of reflection pattern portions for intensively guiding light from the light emitter to each of the key buttons is formed at a surface of the light guiding sheet in correspondence with the plurality of key buttons.

17. The mobile terminal of claim 12, wherein the plurality of key buttons are formed as an integral pad, and the pad comprises:

an opaque layer forming an appearance and having symbols penetratingly formed in correspondence with numbers or characters to be inputted, the opaque layer defining an upper surface for each of the plurality of buttons;

a transparent layer formed at a lower surface of the opaque layer and integral with the opaque layer; and a plurality of pressurizing protrusions formed at a lower surface of the transparent layer, each pressurizing protrusion corresponding to one of the plurality of key buttons and one of the plurality of switches.

18. The mobile terminal of claim 17, wherein the opaque layer is formed of a metallic plate, and the transparent layer is formed of silicon or silicon rubber co-injection molded onto the metallic plate.

19. The mobile terminal of claim 11, wherein the portion of the lower surface free of the adhesive extends generally parallel between all switches of the plurality of switches at the upper portions thereof.

20. The mobile terminal of claim 11, wherein light guiding sheet has a perimeter, and the adhesive is only located at the perimeter.

* * * * *

UNITED STATES PATENT AND TRADEMARK OFFICE

CERTIFICATE OF CORRECTION

PATENT NO. : 7,488,910 B2
APPLICATION NO. : 11/649859
DATED : February 10, 2009
INVENTOR(S) : Hong It is certified that error appears in the above-identified patent and that said Letters Patent is hereby corrected as shown below:

In the Claims

Column 6, lines 11-17 should read as follows:

a plurality of switches formed on the circuitry supporting substrate, each of the plurality of switches corresponding to one of the plurality of key buttons, and each of the plurality of switches having an upper portion;

wherein the lower surface of the light guiding sheet is attached to the upper surface of the circuitry supporting substrate by an adhesive, a portion of the lower surface of the light guiding sheet is free of the adhesive, and the portion of the lower surface free of the adhesive extends generally parallel between at least two switches of the plurality of switches at the upper portions thereof.

Column 7, lines 11-17 should read as follows:

a plurality of switches formed on the circuitry supporting substrate, each of the plurality of switches corresponding to one of the plurality of key buttons, and each of the plurality of switches having an upper portion;

wherein the lower surface of the light guiding sheet is attached to the upper surface of the circuitry supporting substrate by an adhesive, a portion of the lower surface of the light guiding sheet is free of the adhesive, and the portion of the lower surface free of the adhesive extends generally parallel between at least two switches of the plurality of switches at the upper portions thereof.

Signed and Sealed this

Tenth Day of November, 2009

David J. Kappos

David J. Kappos
*Director of the United States Patent and Trademark Office*